US006571493B2

(12) United States Patent
Amano et al.

(10) Patent No.: US 6,571,493 B2
(45) Date of Patent: Jun. 3, 2003

(54) CUTTING EDGE

(75) Inventors: Masaharu Amano, Hirakata (JP); Takanori Nagata, Hirakata (JP); Kazuhide Okawa, Yawata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/742,054

(22) Filed: Dec. 22, 2000

(65) Prior Publication Data

US 2001/0005949 A1 Jul. 5, 2001

(30) Foreign Application Priority Data

Dec. 27, 1999 (JP) ..... 11-371106

(51) Int. Cl.[7] ..... E02F 3/00
(52) U.S. Cl. ..... 37/460; 172/747; 172/701.3
(58) Field of Search ..... 37/460, 446, 449, 37/450, 451; 172/701.3, 702, 703, 704, 747, 781

(56) References Cited

U.S. PATENT DOCUMENTS

| | | | | |
|---|---|---|---|---|
| 3,529,677 | A | * | 9/1970 | Stephenson |
| 3,882,594 | A | * | 5/1975 | Jackson et al. |
| 3,970,445 | A | * | 7/1976 | Gale et al. |
| 4,011,051 | A | * | 3/1977 | Helton et al. |
| 4,052,802 | A | | 10/1977 | Moen et al. ..... 37/141 R |
| 4,086,966 | A | | 5/1978 | Lanz et al. ..... 172/767 |
| 4,686,080 | A | * | 8/1987 | Hara et al. |
| 4,715,450 | A | * | 12/1987 | Hallissy et al. |
| 4,770,253 | A | | 9/1988 | Hallissy et al. ..... 172/701.3 |
| 5,081,774 | A | * | 1/1992 | Kuwano |
| 5,403,544 | A | * | 4/1995 | Adrian et al. |
| 5,427,186 | A | * | 6/1995 | Adrian et al. |
| 5,778,572 | A | * | 7/1998 | Lukavich et al. |
| 5,881,480 | A | * | 3/1999 | Fall |

FOREIGN PATENT DOCUMENTS

| | | |
|---|---|---|
| GB | 1 467 326 | 3/1977 |
| JP | 52-103801 | 8/1977 |
| JP | 53-78602 | 7/1978 |
| JP | 55-85155 | 12/1978 |
| JP | 56-13465 | 2/1981 |
| JP | 60-58691 | 12/1985 |
| JP | 5-54543 | 8/1993 |
| JP | 8-302757 | 11/1996 |
| JP | 9-158144 | 6/1997 |
| JP | 11-166249 | 6/1999 |
| WO | WO 97/4499 | 12/1997 |

* cited by examiner

*Primary Examiner*—Victor Batson
(74) *Attorney, Agent, or Firm*—Armstrong, Westerman & Hattori, LLP.

(57) ABSTRACT

A cutting edge which has improved resistance to scratching wear, such resistance being required for cutting edges for snow removal, which has good performance to increase e.g., compressed snow rate, and which can be manufactured at comparatively low cost. The cutting edge comprises a hard member provided at the leading edge of an edge body, the hard member comprising (i) a hard material containing hard grains which are dispersed with high filling density and integrally combined by a metal having a lower melting point than the hard grains and (ii) a protective member which covers at least the front face of the hard material as viewed in the travel direction of the blade and which has impact resistance.

16 Claims, 28 Drawing Sheets

(a)

(b)

(a)

(b)

(c)

(d)

(e)

(a)

(b)

PRIOR ART

PRIOR ART

PRIOR ART

PRIOR ART

PRIOR ART

PRIOR ART

PRIOR ART

PRIOR ART

CUTTING EDGE

TECHNICAL FIELD

The present invention relates to a cutting edge well suited for use in the blade of a construction machine or track particularly used for snow removal.

BACKGROUND ART

Snow removal conventionally carried out by a motor grader or the like involves operation for removing snow cover and sherbet-like snow and operation for scraping snow which has been compressed into a frozen path (hereinafter called "compressed snow"). Snowremoving cars usually travel at a speed of about 30 km/h for removing snow cover and sherbet-like snow, and in the event of collision with projecting obstacles such as a manhole lid or a joint of a bridge during snow cover removal, a big shock occurs at the cutting edge end of the blade and causes chipping or cracking unless the cutting edge of the blade is made of a material having high toughness. For easy compressed snow removal, snowremoving cars travel with the blade being tilted (to change the angle of the blade edge), thereby grinding the tip of the cutting edge to be sharpened. However, in cases where the material of the blade cutting edge is low in toughness, the cutting edge would be chipped when its angle is changed with its tip portion in a sharpened condition.

For solving the chipping problem of blade cutting edges, there have been proposed, up to now, various means for increasing the durability of a blade cutting edge. Examples of them are as follows.

(1) The most popular one is the cutting edge such as disclosed in Japanese Patent Publication (KOKAI) Gazette No. 9-158144 (1997), which is made from steel for machine construction use (e.g., SCM435) which underwent thermal treatment to have a hardness of $H_{RC}$ 45 to 55. The cutting edge 100 disclosed in this publication is designed as shown in FIG. 21. Specifically, the tip portion 102 of an edge member 101 made from a steel plate of a specified size is sharpened and partially cut to form indents 103 at a specified pitch, thereby forming ground contacting teeth 104 at spaced intervals in the form of saw teeth. Reference numeral 105 is a mounting hole.

(2) The cutting edge 106 disclosed in Japanese Patent Publication (KOKAI) Gazette No. 8-302757 (1996) is designed, as shown in FIG. 22, such that a plurality of teeth 108 made from a hard metal (tungsten carbide) are attached to a main body 107 having high impact resistance. More specifically, a stepped portion 109 is formed at the leading end of the surface of the main body 107 and the plurality of divided teeth 108 arranged in a widthwise direction are brazed to the stepped portion 109.

(3) There are known cutting edges which use, in their leading edges, a hard material in which a hard substance such as crushed hard metal grains is dispersed in a low-melting metal, and examples of such cutting edges are as follows.

① Japanese Utility Model Publication (KOKAI) Gazette No. 55-85155 (see FIG. 23) according to which a hard material 110 is formed by enclosing a core material 111 by a plate 113 made of an appropriate metal (e.g., soft steel), the core material 111 being formed by integral solidification of crushed grains 112 of a hard alloy such as tungsten carbide in a solution of a base metal such as copper alloy.

② Japanese Patent Publication (KOKAI) Gazette No. 56-13465 (see FIG. 24) according to which a hard material 115 is formed by dispersing crushed hard metal grains 117 in a low-melting alloy 118 within a flat box the three side of which are formed from a metal plate (steel plate) 116 which is easy to weld.

③ Japanese Patent Publication (KOKAI) Gazette No. 53-78602 (see FIG. 25) according to which a cutting edge 120 is formed by inserting a wear resistant plate-like piece 121 (hard material) made from a synthetic material containing wear resistant grains 122 so as to be held between two partially thinned steel plates 123, 123 and then integrated with the latter by welds 124, 124' (plug welds).

(4) A cutting edge made of a casting in which the leading end of the edge is provided with hard metal grains as an insert (produced by Pacal (U.S.A.)).

(5) The cutting edge such as disclosed in Japanese Patent Publication (KOKOKU) Gazette No. 5-54543 (see FIG. 26). The cutting edge 125 has an edge body 126 and two kinds of hard metals 127, 127' are brazed to the leading end of the edge body 126 in the form of layers, thereby achieving both wear resistance and impact resistance.

(6) The cutting edge having a bit mounted on its leading end (produced by Kennametal Inc. (USA)).

(7) The cutting edge such as disclosed in PCT Publication WO97/44994 (see FIG. 27). In the cutting edge 130, holes 133 are made at the leading end 132 of an edge body 131 at a specified pitch in a widthwise direction and pins 134 made from a hard metal are inserted into these holes 133 so as to project from the leading end 132 of the edge body 131 by an appropriate length t.

(8) The cutting edge disclosed in Japanese Patent Publication (KOKAI) Gazette No. 11-166249 (see FIG. 28). In the cutting edge 135, a hard material layer 137 is formed on the leading end of an edge body 136 by overlaying of a hard material.

The above known techniques have, however, revealed the following disadvantages. The cutting edge (1) is inexpensive and less dangerous, but has short service life, requiring frequent edge replacement. Service life can be improved by increasing the thickness of the edge, but this disadvantageously increases ground contact area and therefore decreases ground contact pressure, entailed by decreased compressed snow removal performance. With intent to increase compressed snow removal performance, the ground contact teeth 104 are arranged at spaced intervals in the form of comb teeth as shown in FIG. 21. However, increased ground contact pressure causes significant wear, resulting in extremely short life.

The cutting edge (2) shown in FIG. 22 uses teeth 108 made of a hard metal without processing/treatment, so that the cutting edge (2) costs high and has a high risk of breakage due to big cracks if the very brittle hard metal teeth directly collides with projecting obstacles such as rocks.

The following problem is presented by the cutting edges (3) which use a hard material of a structure in which a hard substance such as crushed hard metal grains is dispersed within a low-melting metal. Since wear due to scratching mainly occurs in snow removal, if the hard metal grains (hard grains) are small in size, the supporting base metal part is scooped away and looses its supporting force so that the hard metal grains drop off before they exert their intrinsic wear resistance. As a result, high wear resistance cannot be achieved.

The cutting edge (3)-① shown in FIG. 23 is formed by cladding the core material 111 with the plate 113 made of soft steel such that the plate 113 encloses the entire periphery of the core material 111 in its longitudinal section, and therefore the hard grains (crushed grains 112) to be contained in the hard material cannot be introduced from other areas than the longitudinal end face. This cutting edge, therefore, suffers from the problem that where the entire length of the hard material is long, large-sized hard grains are difficult to introduce and likely to be nonuniformly dispersed.

The cutting edge of (3)-② shown in FIG. 24 has the disadvantage that where the hard material is welded to a blade or the like at the retaining back face which is formed by the metal plate (steel plate) 116 and located opposite to the surface in which the hard grains (crushed grains 117) are dispersed, the surface having the hard grains (crushed grains 117) are easily chipped or broken as it is susceptible to impact force due to direct collision with soil and rocks. The cutting edge (3)-③ shown in FIG. 25 is complicated in structure and costly.

The cutting edge (4) has a disadvantage attributable to its manufacturing process which involves internal casting of the edge. Specifically, with this process, the thickness of the edge is increased so that ground contact pressure decreases, causing difficulty in compressed snow removal, and further, poor toughness increases the risk of chipping.

The cutting edge (5) (see FIG. 26) is efficient, enjoying long service life, but its manufacturing cost is very high. In addition, the edge is thick at its leading end, which causes decreased ground contact pressure and therefore difficulty in compressed snow removal.

The cutting edge (6) having a bit mounted on its leading edge is also very expensive. Although this cutting edge effectively works in compressed snow removal but suffers from the problem of remaining snow in snow removal.

The cutting edge (7) shown in FIG. 27 has the same problems as those of the cutting edge (6), and additionally, it has the disadvantage that the hard metal pins 134 easily drop off in service.

The cutting edge (8) shown in FIG. 28 has the hard material layer 137 overlaid on its front face and this hard material layer 137 is easily chipped when tilting the cutting edge during snow removal, so that long service life cannot be expected.

The present invention has been directed to overcoming the foregoing problems and a prime object of the invention is therefore to provide a cutting edge which exhibits excellent wear resistance with respect to friction caused by scratching, this resistance being particularly required for cutting edges for snow removal, which provides increased efficiency in compressed snow removal, and which can be manufactured at comparatively low cost.

DISCLOSURE OF THE INVENTION

The above object can be achieved by a cutting edge according to the invention which comprises an edge body mounted on a blade and a hard member provided at the leading end of the edge body, wherein the hard member comprises:

- a hard material containing hard grains which are dispersed with high filling density and are integrally combined by a metal having a lower melting point than the hard grains; and
- a protective member which covers at least the front face of the hard material as viewed in the travel direction of the blade and which has impact resistance.

According to the cutting edge of the invention, since a hard material formed from hard grains dispersed with high filling density and combined by a low-melting metal is mounted with an impact-resistant protective member attached to its front side as viewed in the travel direction of the blade, the protective member (i.e., steel material portion) positioned on the front face of the hard material protects the hard material so that the hard material will not be chipped if impact is exerted thereon. If the blade is tilted, the leading edge of the edge body will be sharpened but will not be chipped because the leading end portion is made from e.g., steel. Since the edge is formed from the hard material protected by the protective member, it has resistance to scratching wear and, in consequence, can be used for a long time.

In the invention, the protective member is preferably constituted by a part of the edge body. With this arrangement, the edge body doubles as the protective member for the hard material and there is no need to form the protective member separately.

In this case, the hard material may be disposed on the back face side of the edge body as viewed in the travel direction of the blade and at least the back face of the hard material as viewed in the travel direction of the blade may be covered with the steel plate. In addition, the edge body may be provided with a groove at its ground contact face and the hard material may be disposed within the groove.

In the invention, the protective member may be distinct from the edge body, formed by bending a steel plate into a substantially L shape and attached to the leading end of the edge body. Alternatively, the protective member may be distinct from the edge body, formed by bending a steel plate so as to cover the three faces of the edge body excluding its ground contact face and attached to the leading end of the edge body.

In the invention, it is preferable that the hard grains be crushed and/or granulated grains of a hard metal mainly containing a tungsten carbide alloy. As the low-melting metal, Cu, a Cu alloy or an Ni self fluxing alloy is preferably used.

In the invention, the hard material preferably contains large diameter hard grains having diameters of 1 mm or more and distributed in the entire area of the hard material. Since the parent phase metal retaining the hard grains is firstly worn, if the hard grains are small in size, the retaining force of the parent phase metal for the hard grains is weakened so that the hard grains easily drop off. On the other hand, if the hard grains are large in size, they are unlikely to drop off because of the strong retaining force of the parent phase metal. In cases where the hard grains have diameters of 1 mm or more, even if the hard grains project from the wear surface by 1 mm, there remains, on the rear side as viewed in the travel direction of the blade, the parent phase metal supporting the hard grains, so that the hard grains are unlikely to drop off. Moreover, the projecting hard grains function to scrape compressed snow. For this reason, it is desirable for cutting edges for snow removal to use large hard grains having diameters of 1 mm or more.

By blending and distributing the large diameter hard grains and small diameter hard grains having diameters of 0.5 mm or less, the filling density of the hard grains can be increased. In addition, filling with large and small diameter hard grains at high density has the effect of increasing resistance to scratching wear and therefore service life, since the gaps between the large diameter hard grains are filled with the small diameter hard grains, thereby reinforcing the hard material.

It is preferable to make the leading end of the hard member such that thick portions and thin portions are alternately arranged in the widthwise direction of the edge body. This makes parts of the leading end thin, thereby increasing ground contact pressure and therefore compressed snow removal performance can be improved. In addition, the combination of the steel portion having impact resistance throughout it and the hard material having high wear resistance prevents chipping and excessive wear, so that durability is increased and improved service life is consequently ensured.

Preferably, the hard materials are spaced at appropriate intervals in the widthwise direction of the edge body at the leading end of the hard member. With this arrangement, the areas where no hard material is provided are preferentially worn, forming slight unevenness at the leading end of the hard member with the areas provided with the hard material becoming convex and having increased ground contact pressure, so that compressed snow removal performance can be improved.

It is also preferable that the hard materials different in wear resistance be alternately arranged in the widthwise direction of the edge body at the leading end of the hard member. Thanks to the difference in wear resistance, the tips of the areas where the hard material having higher wear resistance is disposed slightly project so that the ground contact pressure at the projecting areas increases with improved compressed snow removal performance like the foregoing case and service life is also extended.

Preferably, the hard member is attached to the leading end of the edge body by infiltration of the low-melting metal. This arrangement has the advantage that the hard material containing the hard grains mixed and dispersed therein at high density can be easily manufactured and can be securely mounted on the edge body. Also, the infiltration has such an advantage in manufacture, particularly, in cases where thick portions and thin portions are alternately arranged in the widthwise direction of the edge body to form the leading end of the hard member, that the thickness of the hard member can be easily varied by corrugating the wall portion when constructing the outer shell with the member having impact resistance.

The hard member may be attached to the leading end of the edge body by welding. Alternatively, it may be attached to the leading end of the edge body by brazing. It is also possible to attach the hard member to the leading end of the edge body by bolting. The same effect as described earlier can be attained by any of these means.

BEST MODE FOR CARRYING OUT THE INVENTION

Referring now to the accompanying drawings, cutting edges will be described in accordance with preferred embodiments of the invention.

Figure 1:
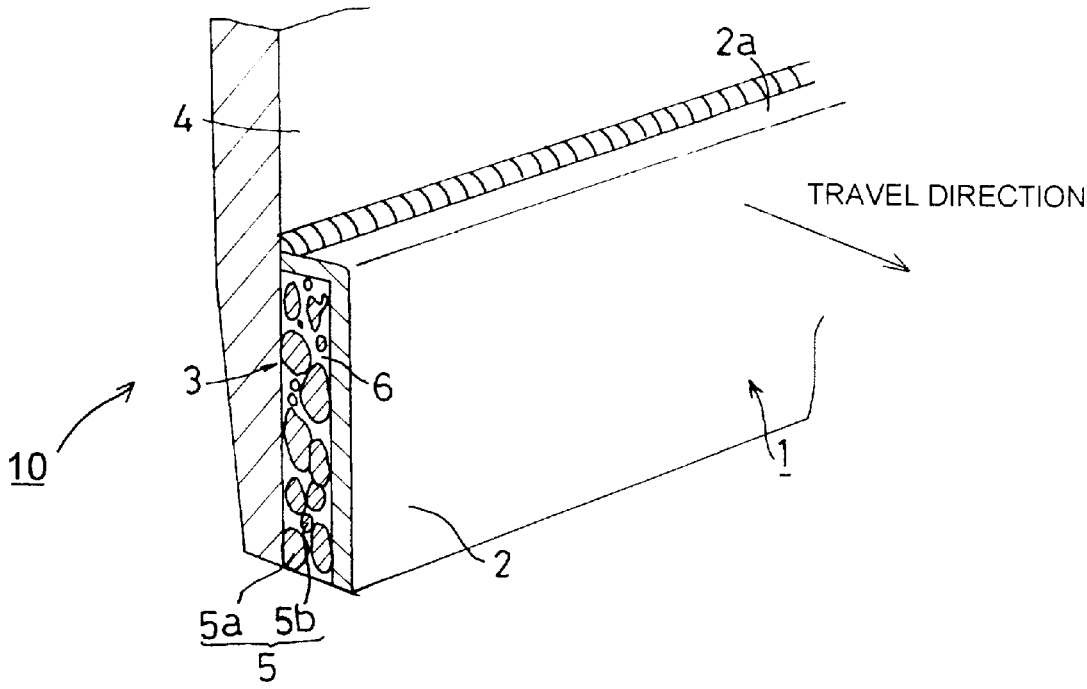
FIG. 1 is a perspective view showing a part of a cutting edge constructed according to a first embodiment of the invention.
Figure 2:
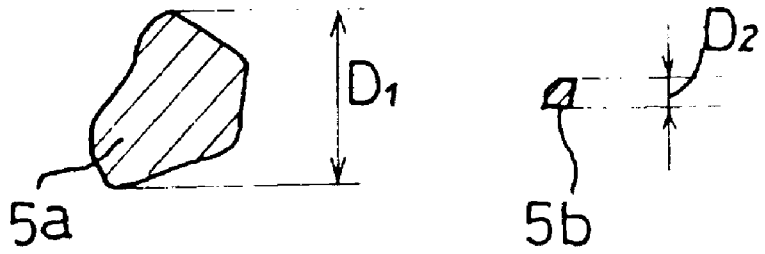
FIG. 2 shows the sizes of hard grains to be introduced.

FIG. 1 is a perspective view showing a part of a cutting edge constructed according to a first embodiment of the invention. FIG. 2 shows the sizes of hard grains to be introduced.

A cutting edge 10 according to the first embodiment is attached to the leading end of a blade 11 (see FIG. 18) for the purpose of mainly improving resistance to scratching wear. The cutting edge is comprised of an edge body 4 attached to the blade 11 and a hard member 1 attached to the leading end of the edge body 4 on the side facing in the travel direction of the blade 11. The hard member 1 includes a protective member 2 having impact resistance and a hard material 3 that is disposed on the back of the protective member 2 for improving wear resistance.

The protective member 2 is formed by bending a steel plate into a form having a substantially L-shaped cross section of specified size with one leg being shorter than the other. The steel plate has an appropriate thickness and is made of rolled steel for general structure or carbon steel for machine structural use.

The hard material 3 two faces of which are enclosed by the protective member 2 contains grains (hereinafter referred to as "hard grains 5") formed by crushing or granulating a hard metal (e.g., tungsten carbide alloys) or cermet. The hard material 3 is formed in the following way: the hard grains 5 having large grain diameters (hereinafter referred to as "large diameter grains 5*a*") and those having small grain diameters (hereinafter referred to as "small diameter grains 5*b*") are blended and distributed with high filling density; and then, a metal 6 (e.g., Cu metals, Cu alloys and Ni self-fluxing alloys such as bronze) having a lower melting point than the hard grains 5 is melted and injected to infiltrate and integrally solidify the hard grains 5. More specifically, the hard material 3 is formed, using a temporal container that is made of a steel plate and temporarily encloses the peripheral face of the resultant hard material 3 except one side confronting the protective member 2. The large diameter grains 5*a* and small diameter grains 5*b* of the hard grains 5 are blended and introduced at high density into the space defined by the container and then, the metal 6 having a low melting point is melted and injected. The mixture is solidified to have a specified size. After the solidification of the low-melting metal 6, the steel plate serving as the temporal enclosure are got rid of.

As described above, the protective member 2 is formed by bending a steel plate so as to have a substantially L-shaped section and a specified outside dimension, so that when mounting the protective member 2 on the edge body 4, welding or brazing can be easily carried out with a short leg part 2*a* facing up. In addition, when great impact force is exerted on the cutting edge 10, the protective member 2 protects the hard material 3, preventing breakage as the protective member 2 is positioned in front of the hard material 3. Regarding the hard material 3 inside the cutting edge 10, the hard grains 5 dispersed and infiltrated include, as shown in FIG. 2, the large diameter grains 5*a* having diameters $D_1$ of no less than 1 mm and the small diameter grains 5*b* having diameters $D_2$ of no more than 0.5 mm. With this arrangement, the filling factor of the hard grains 5 is increased with respect to the space (i.e., the space inside the container temporarily made during the formation of the hard material portion) behind the protective member 2 and dropping off of the hard grains 5 due to scratching friction is prevented, whereby improved wear resistance is ensured. In consequence, the hard member 1 having both impact resistance and wear resistance and ensuring long service life can be achieved.

Figure 3:
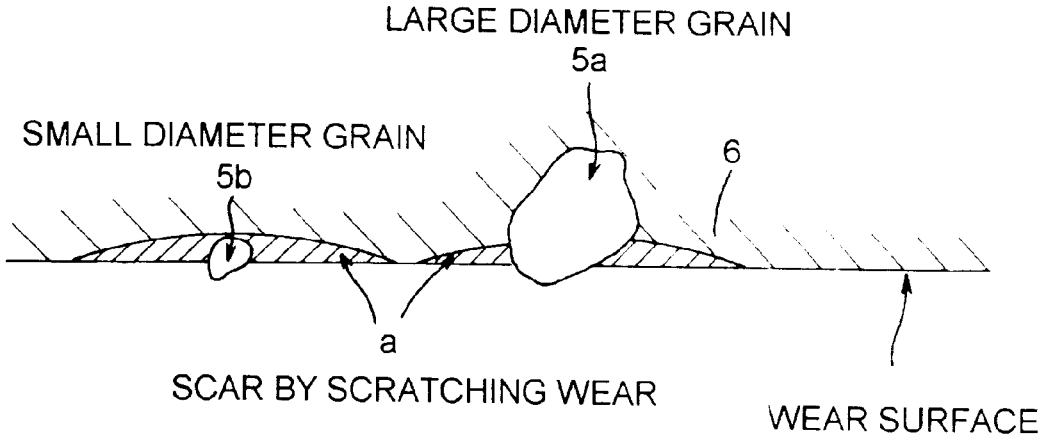
FIG. 3 diagrammatically shows hard grains dropped due to scratching wear.

Regarding the size distribution of the hard grains 5 which constitutes the hard material 3, it is necessary to employ large sized grains lest that the dispersed hard grains 5 drop off. If the dispersion density is low, a scar a is caused by scratching wear so as to scoop the area (i.e., the low-melting metal 6 which serves as a binder for the hard grains 5) around the large diameter grain 5*a* as diagrammatically shown in FIG. 3 so that even the dropping frequency of the large diameter grains Sa increases, resulting in short service life. To solve this problem, the large diameter grains 5*a* and the small diameter grains 5*b* are blended and introduced so that the gaps between the large diameter grains 5*a* are filled with the small diameter grains 5*b,* and, in consequence, the overall filling rate of the hard grains 5 can be increased. As a result, the large diameter grains 5*a* can be reinforced by the small diameter grains 5*b* dispersed in a mingled condition around the large diameter grains, thereby preventing the low-melting metal 6 which serves as a binder from being easily abraded by scratching wear to prohibit floating of the large diameter grains 5. This leads to an improvement in overall wear resistance.

A scratching wear test was conducted on a single piece of the hard material 3. As specimens, there were used three kinds of hard materials that are a hard material containing only the large diameter grains 5*a,* a hard material containing only the small diameter grains 5*b* and a hard material containing a mixture of the large diameter grains 5*a* and the small diameter grains 5*b*. The condition of a wear surface in each material was observed. It was found in the hard material containing only the large diameter grains 5*a* that the parent phase metal (i.e., the metal 6 having a low melting point) around the hard grains was preferentially worn, but no dropping-off occurred since the grains were large in size. In the hard material containing only the small diameter grains 5*b,* the parent phase metal was similarly worn and dropping-off was admitted since the grains were small in size. The hard material, which contained both small diameter and large diameter grains, was found to have the smallest wear amount with wear in the parent phase metal around the large diameter grains being markedly reduced. Of course, dropping-off of the large diameter grains did not occur in this material. The result of this test will be further explained later.

Figure 4:
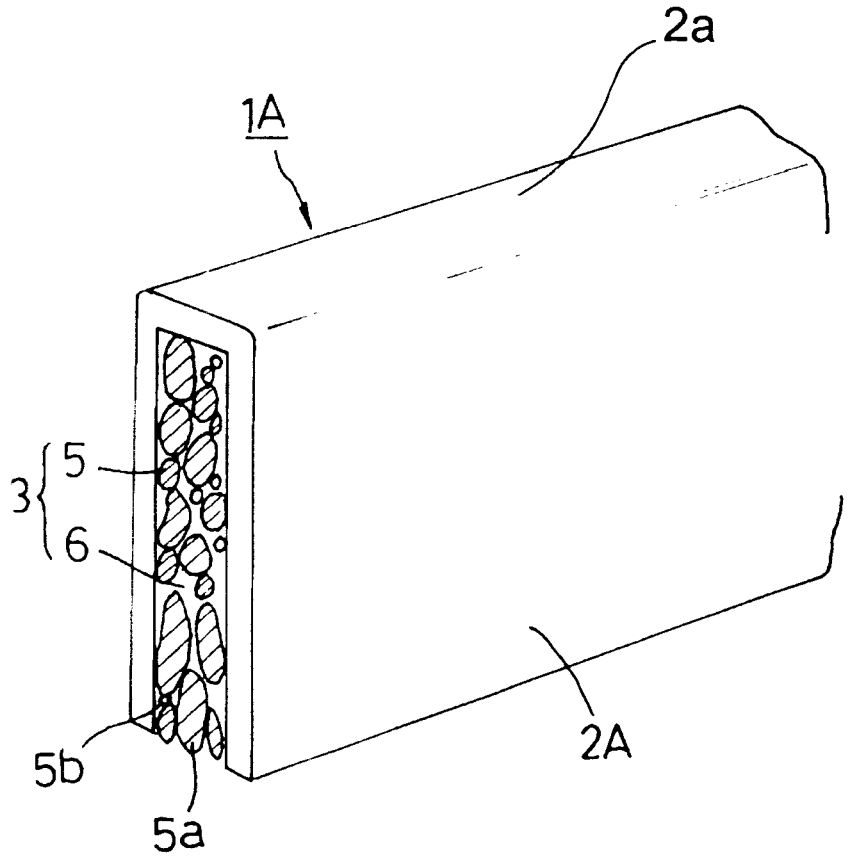
FIG. 4 is a perspective view of a hard member serving as a part of a cutting edge according to a second embodiment.

Next, reference is made to FIG. 4 that shows a perspective view of a hard member serving as a part of a cutting edge constructed according to a second embodiment. The basic structure of the hard member 1A of the second embodiment is similar to that of the first embodiment. Therefore, the same or similar parts will be designated by the same reference numerals given to the first embodiment and a detailed explanation of them will be omitted.

The hard member 1A is formed such that a protective member 2A encloses the hard material 3 except the ground contact face of the hard material 3. More concretely, the hard material 3 is integrally formed with and disposed inside the protective member 2A by combining the hard grains 5 which are a mixture of the large diameter grains 5*a* and the small diameter grains 5*b* and which have been introduced at high density, by means of the molten and injected low-melting metal 6, the protective member 2A being made in the form of a container by bending a steel plate of an appropriate thickness so as to have a specified outside dimension.

The hard member 1A of the second embodiment having the above structure is directly attached by arc welding or brazing to the leading end of the front face of the edge body 4 through the short leg part 2*a* of the protective member 2A. The function of the hard member 1A is the same as that of the first embodiment.

Figure 5:
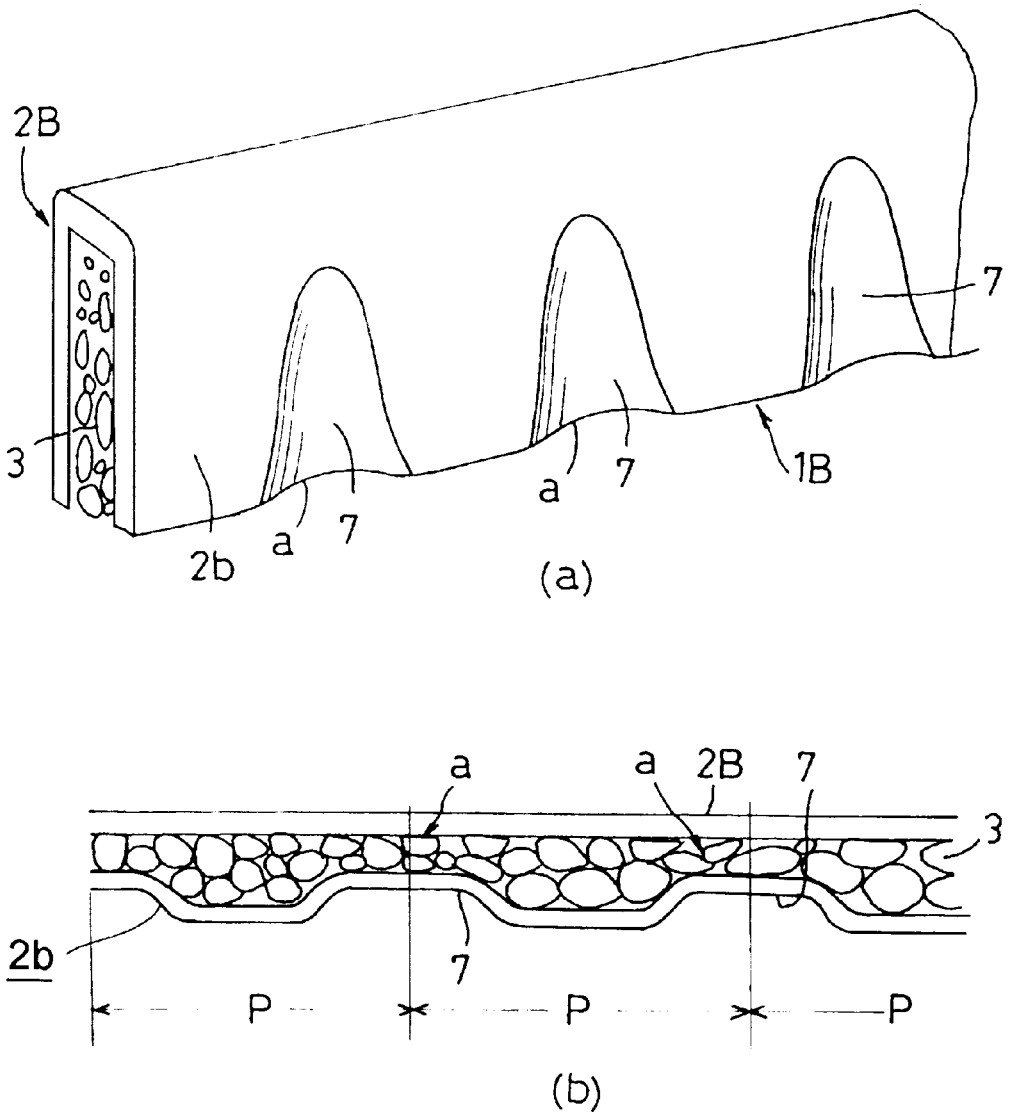
FIGS. 5(*a*) and 5(*b*) are a perspective view and bottom view, respectively, of a hard member serving as a part of a cutting edge according to a third embodiment.

FIGS. 5(*a*) and 5(*b*) show a perspective view and a bottom view, respectively, of a hard member serving as a part of a cutting edge according to a third embodiment The basic structure of the hard member 1B of the third embodiment is similar to those of the first and second embodiments. Therefore, the same or similar parts will be designated by the same reference numerals given to the first and second embodiments and a detailed explanation of them will be omitted.

The hard member 1B is varied to have alternate thicknesses by forming thin wall portions at specified intervals P in the widthwise direction of the blade 11. This structure is made in such a way that the back face 2*b* (i.e., the back of the protective member 2B when attached to the edge body 4) of a protective member 2B is pressed at the specified intervals P to form recesses 7 and a layer of the hard material 3 is formed within the protective member 2B so as to be integral therewith similarly to the foregoing embodiment.

With this arrangement, ground contact pressure can be increased by the thin wall portions a so that compressed snow removal performance can be improved. The outer face is covered with the protective member 2B made of steel, leading to improved impact resistance and the tip is composed of the hard material 3, leading to improved wear resistance, so that long service life can be ensured.

Figure 6:
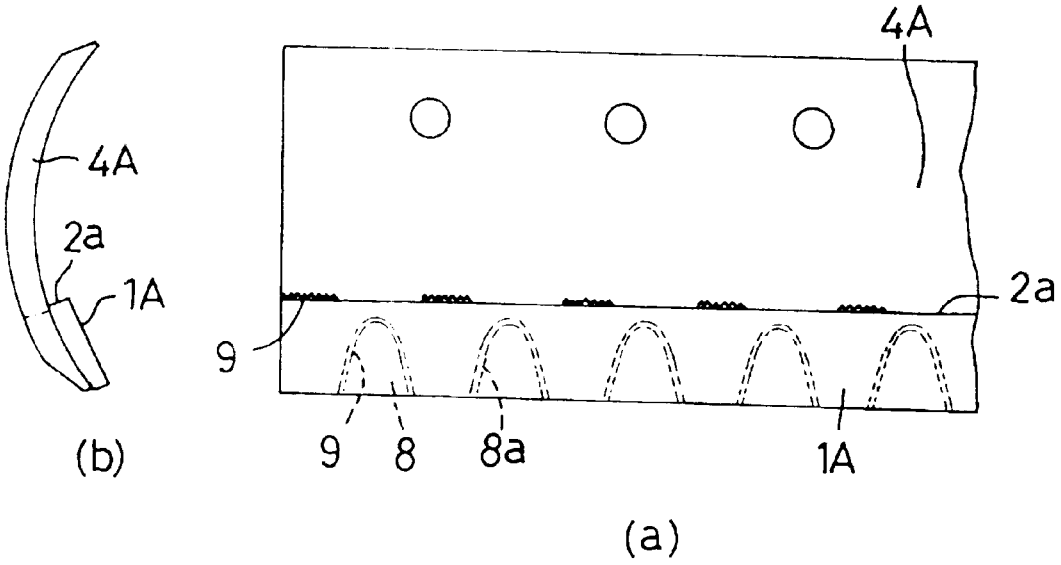
FIGS. 6(*a*) and 6(*b*) are a partial front view and side view, respectively, of a cutting edge according to a fourth embodiment.

The above structure in which the thick wall portions and the thin wall portions are alternately provided may be embodied by other structures such as shown in FIGS. 6(*a*) and 6(*b*) in which the hard member 1A described in the second embodiment is mounted on the leading end of the front face of the comb-teeth-like edge body 4A by attaching an upper edge 2*a* to an edge 8*a* of an indent 8 of each comb tooth portion by arc welding 9. As such, the portions corresponding to the indents 8 of the comb teeth can be made thinner than other areas so that increased ground contact pressure and, in consequence, improved compressed snow removal performance can be achieved. It should be noted that the hard member attached to the leading end of the comb-teeth-like edge body 4A may be the same as that of the third embodiment.

Figure 7:
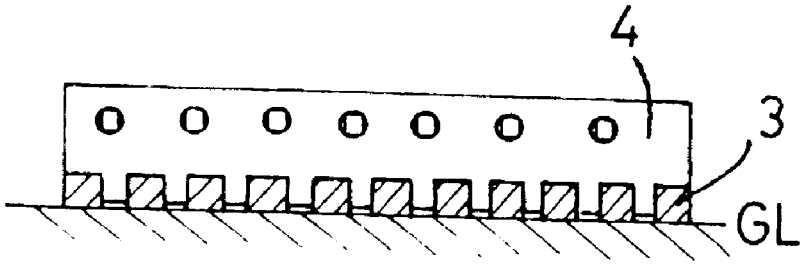
FIG. 7 is a view of a cutting edge constructed according to a fifth embodiment.

The embodiment in which thick wall portions and thin wall portions are alternately made in the tip of the cutting edge may be modified as shown in FIG. 7 which illustrates a hard member according to a fifth embodiment. According to this embodiment, at least the front face of the tip of the edge body 4 of a flat blade is provided with the hard materials 3 which are respectively protected by the protective member 2 and spaced at specified intervals. With this arrangement, other areas than the hard materials 3 are worn in service, leaving the hard materials 3 unworn so that the hard materials 3 become slightly higher than the other areas, which leads to an improvement not only in service life but also in compressed snow removal performance.

Figure 8:
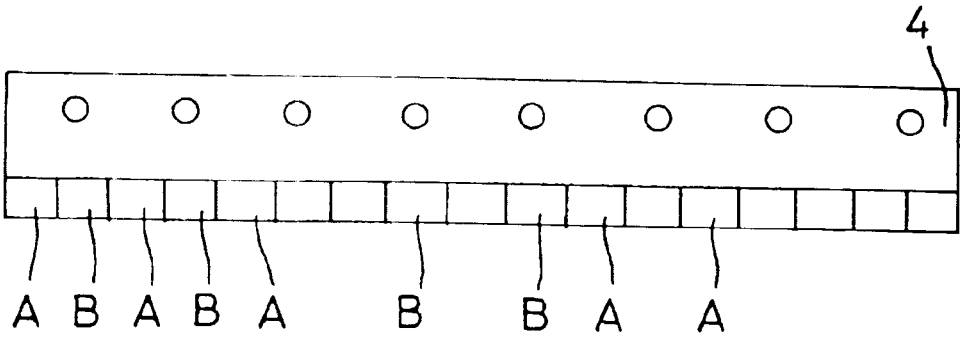
FIG. 8 is a view of a cutting edge constructed according to a sixth embodiment.

FIG. 8 shows a cutting edge constructed according to a sixth embodiment. According to this embodiment, hard materials A and hard materials B, which differ from each other in wear resistance, are alternately disposed at appropriate intervals along the width of the leading end of the edge body 4. In this case, the hard material of the second embodiment is used as the hard material A having higher wear resistance, whereas the hard material B having slightly lower wear resistance is made such that the large diameter grains are distributed in a lower proportion than that of the hard material A. By virtue of this arrangement, the tip areas where the hard materials A having higher wear resistance are disposed become slightly protruding, so that compressed snow removal performance can be improved as described earlier and, in addition, a durable cutting edge can be obtained.

Figure 9:
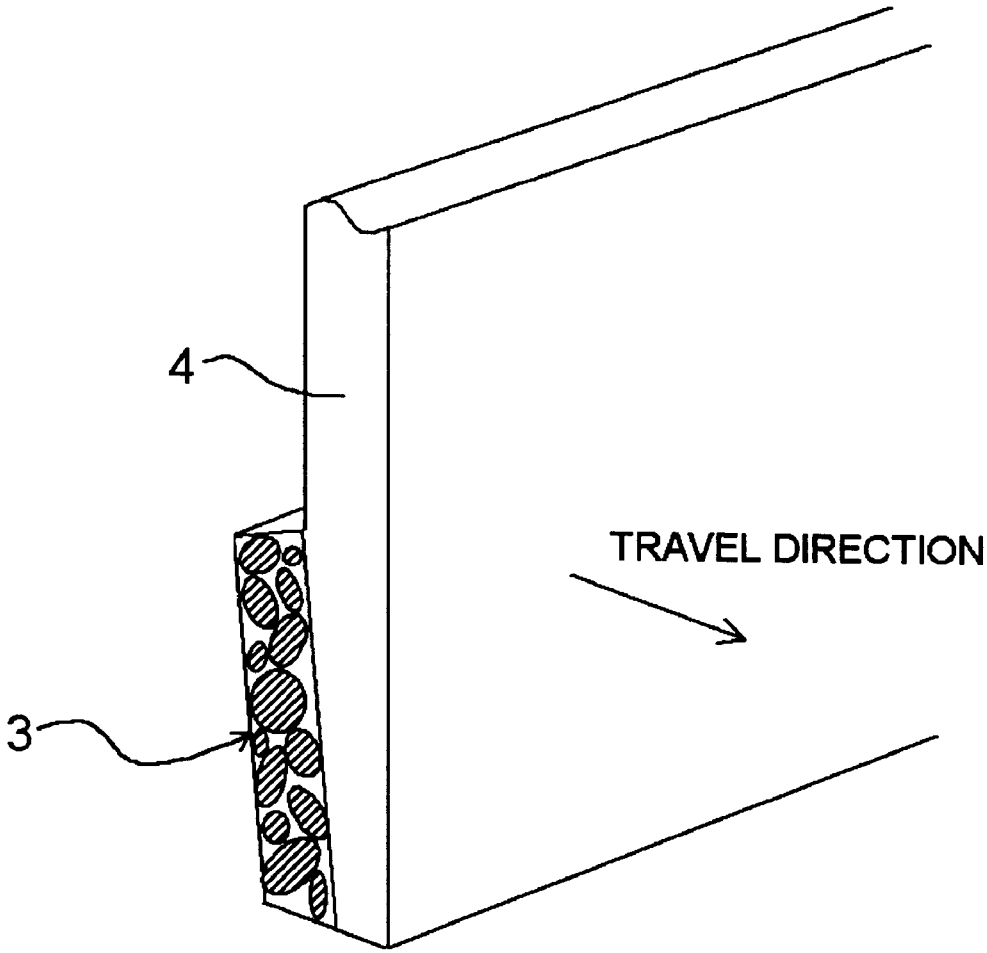
FIG. 9 is a view of a cutting edge constructed according to a seventh embodiment.

FIG. 9 shows a cutting edge constructed according to a seventh embodiment. While the first to sixth embodiments have the protective member made separately from the edge body 4, the seventh embodiment has the edge body 4 which doubles as the protective member. More specifically, the cutting edge of the present embodiment is designed to have the hard material 3 which is brazed to the back of the edge body 4 as viewed in the travel direction. In this case, as seen from FIG. 8, there is no need to employ a steel material for covering the soft material 3.

Figure 10:
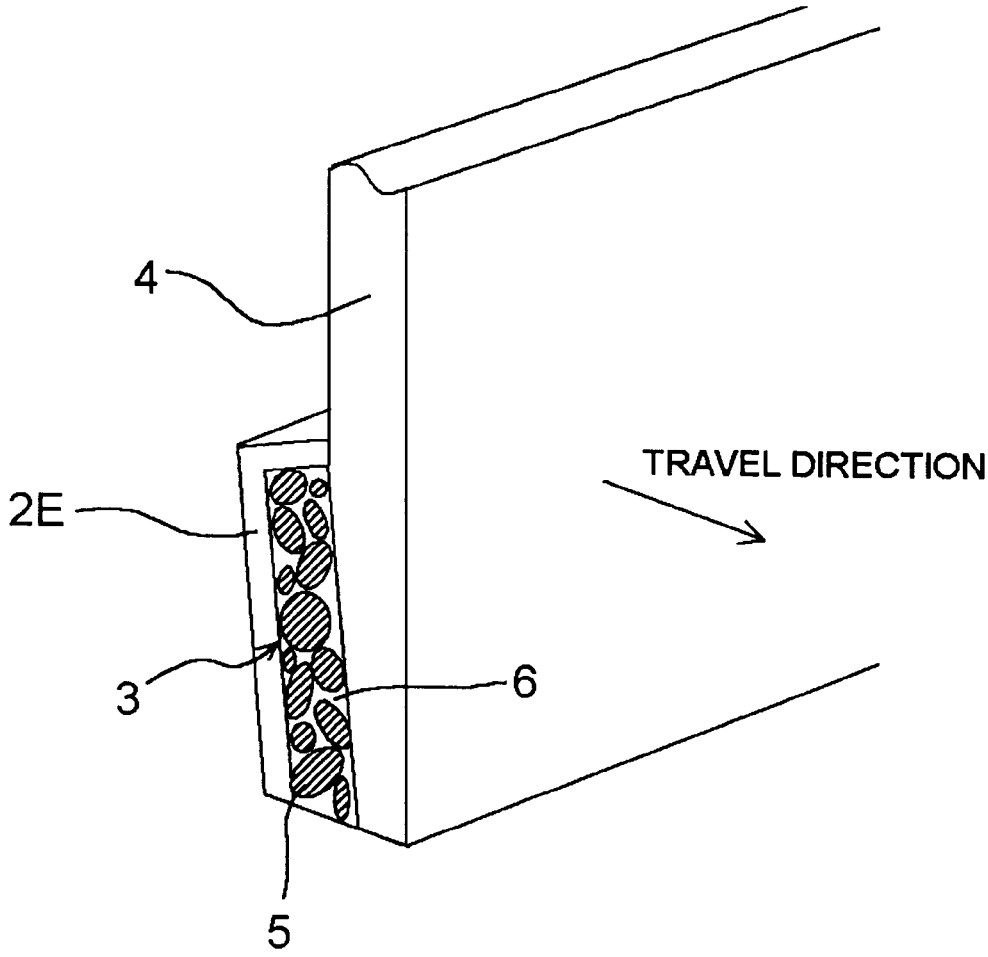
FIG. 10 is a view of a cutting edge constructed according to an eighth embodiment.

FIG. 10 shows a cutting edge according to an eighth embodiment. This embodiment is designed such that the hard material 3 is attached to the back of the edge body 4 as viewed in the travel direction, by making use of the manufacturing process for the hard material 3. Concretely, after a steel plate 2E is bent so as to have a substantially L-shaped cross section and then attached to the back face of the edge body 4, the gap between the edge body 4 and the steel plate 2E is filled with the hard grains 5 such that the hard grains 5 are mingled and dispersed at high density, and then, the metal 6 having a lower melting point than that of the hard grains 5 is infiltrated, whereby the hard material 3 is formed and securely joined to the edge body 4 at the same time. In this case, it is possible to form the hard material 3 beforehand, and attach it to the edge body 4 by brazing.

Figure 11:
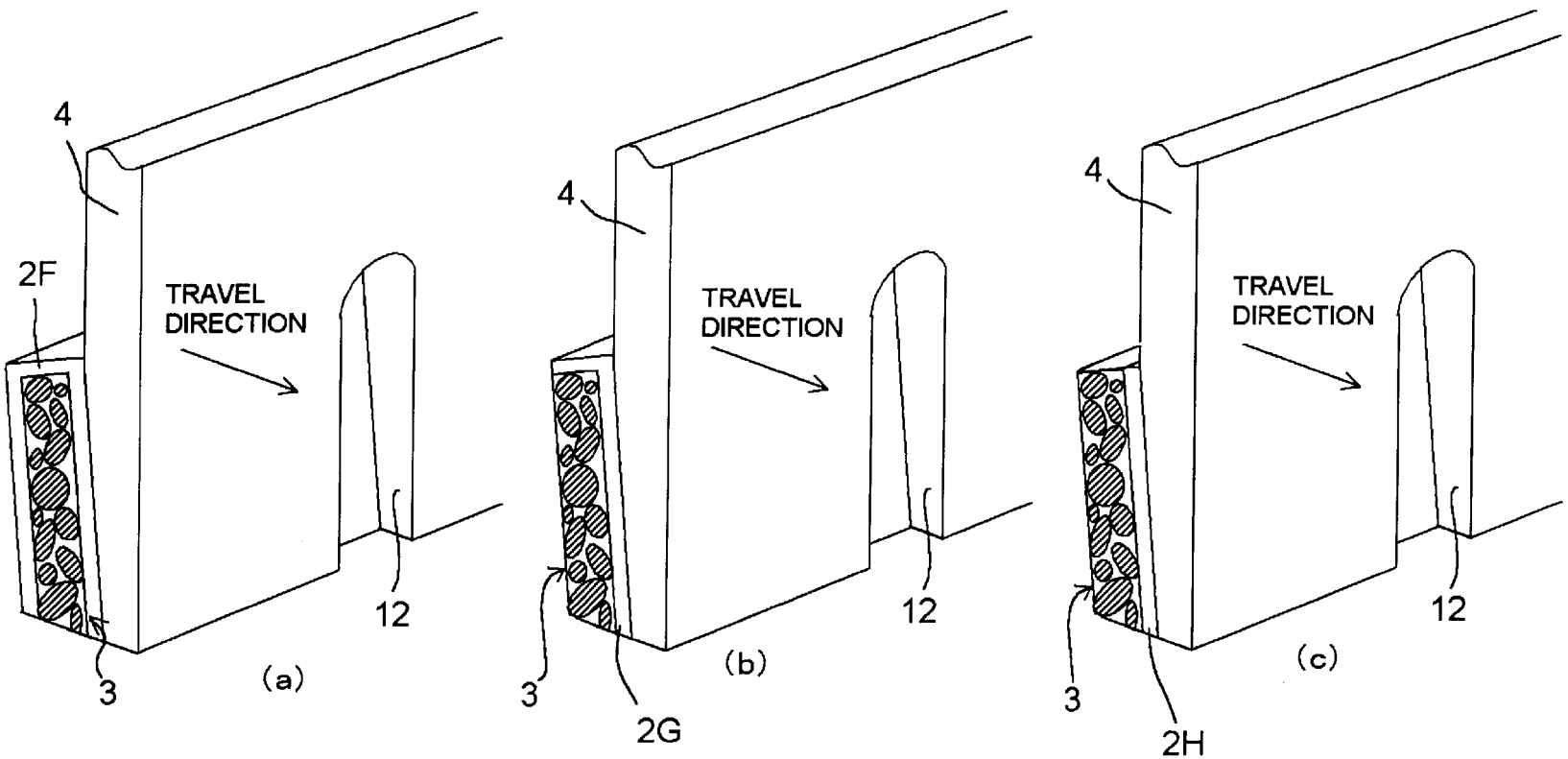
FIGS. 11(*a*), 11(*b*) and 11(*c*) are views of a cutting edge constructed according to a ninth embodiment.

FIGS. 11(*a*), 11(*b*), 11(*c*) each show a cutting edge according to a ninth embodiment. In this embodiment, at least the contact face of the hard material 3 relative to the edge body 4 is covered with a steel plate 2F, 2G or 2H. In the example shown in FIG. 11(*a*), other faces of the hard material 3 than its ground contact face are covered with the steel plate 2F. In the example shown in FIG. 11(*b*), two faces of the hard material 3, that are the face confronting the edge body 4 and the top face are covered with the steel plate 2G. In the example shown in FIG. 11(*c*), only the face confronting the edge body 4 is covered with the steel plate 2H. In any examples, indents 12 are formed in the edge body 4 and the steel plate 2F, 2G or 2H is attached to the edge body 4 by arc welding at the fringe of each indent 12. It should be noted that in this case, the hard material 3 may be preformed and then attached to the edge body 4 by brazing.

Figure 12:
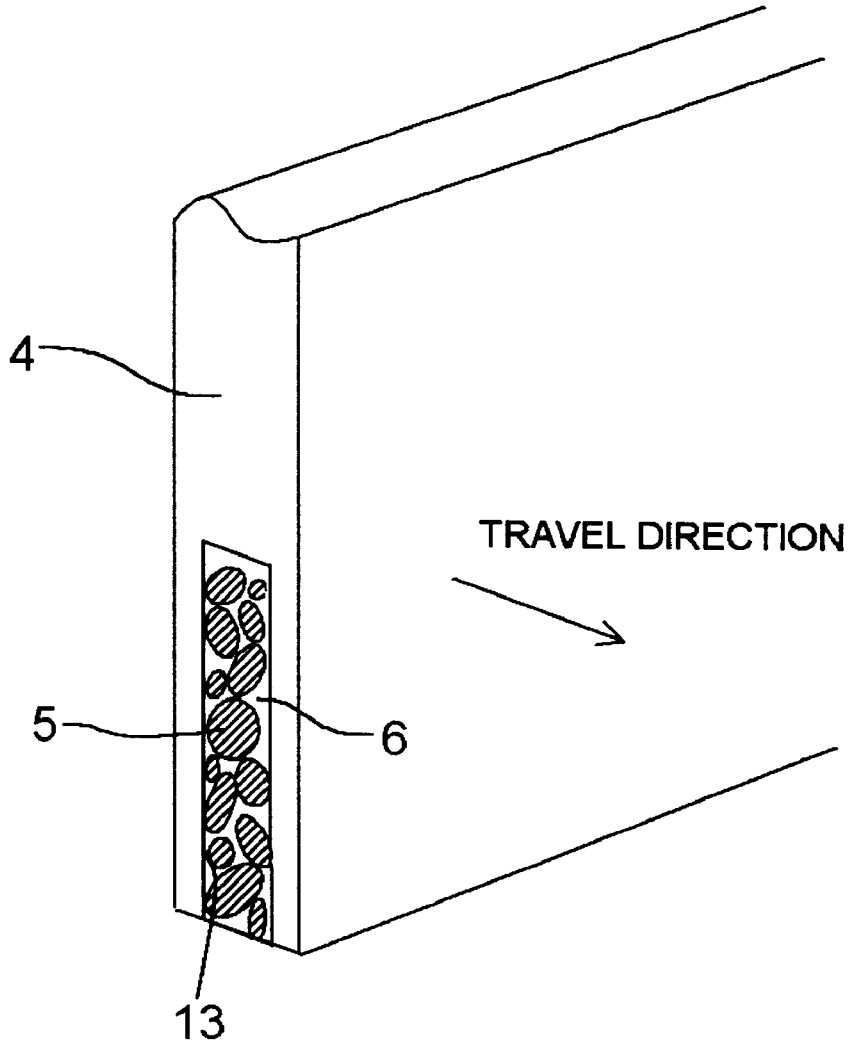
FIG. 12 is a view of a cutting edge constructed according to a tenth embodiment.

FIG. 12 shows a cutting edge constructed according to a tenth embodiment. In this embodiment, a groove 13 is formed on the ground contact face side of the edge body 4; the hard grains 5 are blended and introduced into this groove 13 so as to be dispersed at high density; and the low-melting metal 6 is inflated, whereby the hard material 3 is formed and securely joined to the edge body 4. It is also possible in this case to make the hard material 3 beforehand and attach it within the groove 13 of the edge body 4 by brazing.

Figure 13:
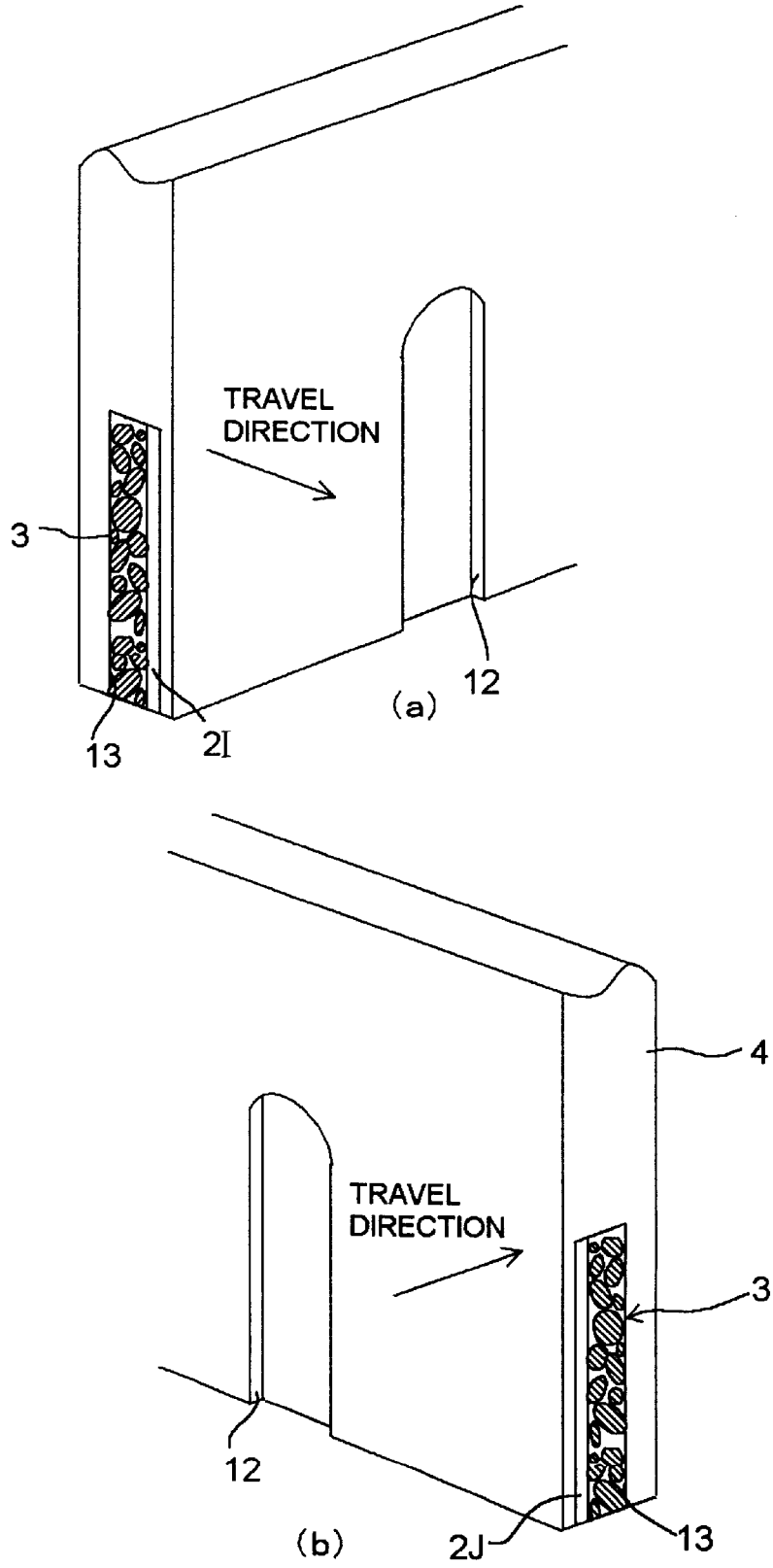
FIGS. 13(*a*) and 13(*b*) are views of a cutting edge constructed according to an eleventh embodiment.

FIGS. 13(*a*), 13(*b*) each show a cutting edge constructed according to an eleventh embodiment. This embodiment is designed such that: the front face of the hard material 3 as viewed in the blade travel direction is covered with a steel plate 21 or the back face of the hard material 3 which is opposite to the front face is covered with a steel plate 2J; the hard material 3 is inserted into the groove 13 of the edge body 4 together with the steel plate 2I or 2J; and the steel plate 21 or 2J is attached to the edge body 4 by arc welding at the fringe of each indent 12 formed in the edge body 4. In this case, the hard material 3 may be preformed and attached within the groove 13 of the edge body 4 by brazing.

Figure 14:
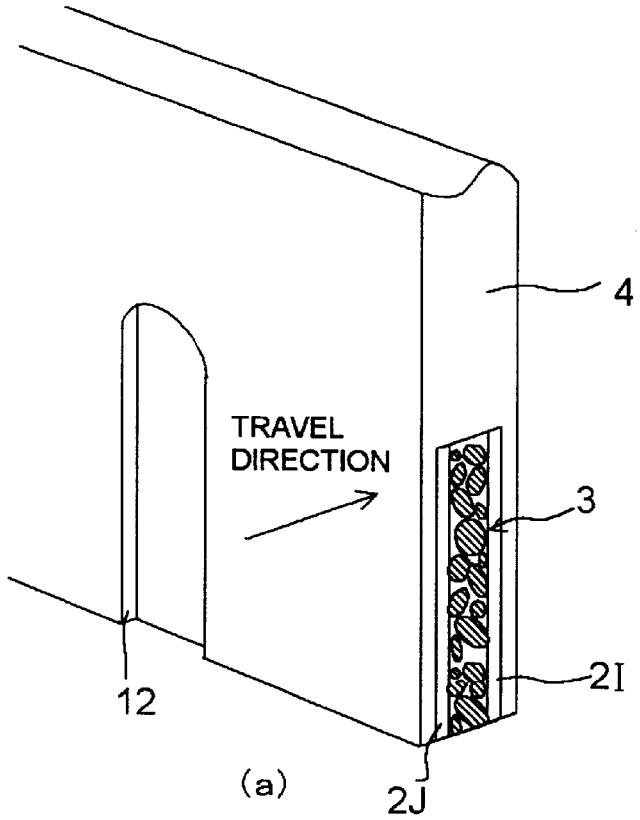
FIGS. 14(*a*) and 14(*b*) are views of a cutting edge constructed according to a twelfth embodiment.
Figure 14:
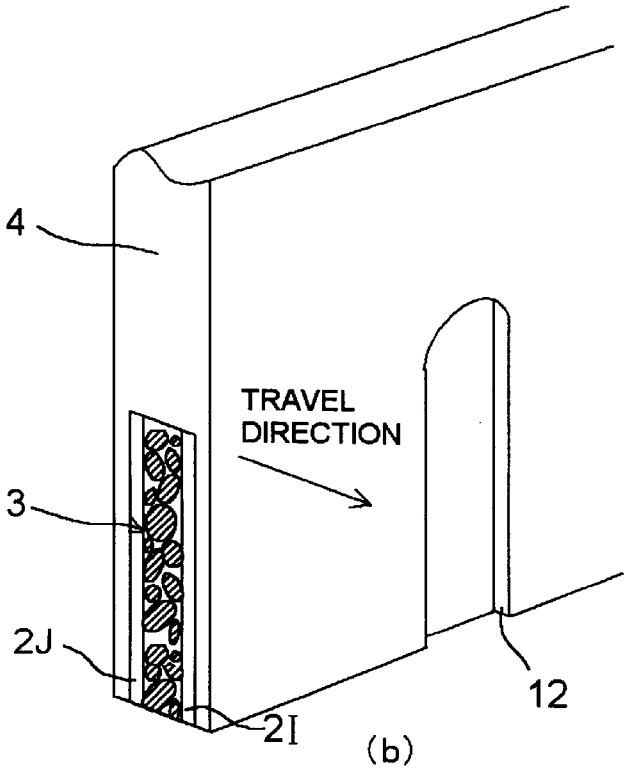

FIGS. 14(*a*), 14(*b*) each show a cutting edge according to a twelfth embodiment. In this embodiment, the front and back faces of the hard material 3 as viewed in the blade travel direction are covered with the steel plates 21 and 2J respectively, and the steel plate 2I or 2J is attached to the edge body 4 by arc welding at the fringe of each of the indents 12 which are formed on the front or back face of the edge body 4 as viewed in the blade travel direction.

Next, other means for attaching the hard member to the edge body will be explained. Although the hard member is attached to the front face of the edge body as viewed in the blade travel direction in the following description, it is apparent that the means used in attaching are applicable to the case where the hard member is attached to the back face of the edge body as viewed in the travel direction.

Figure 15:
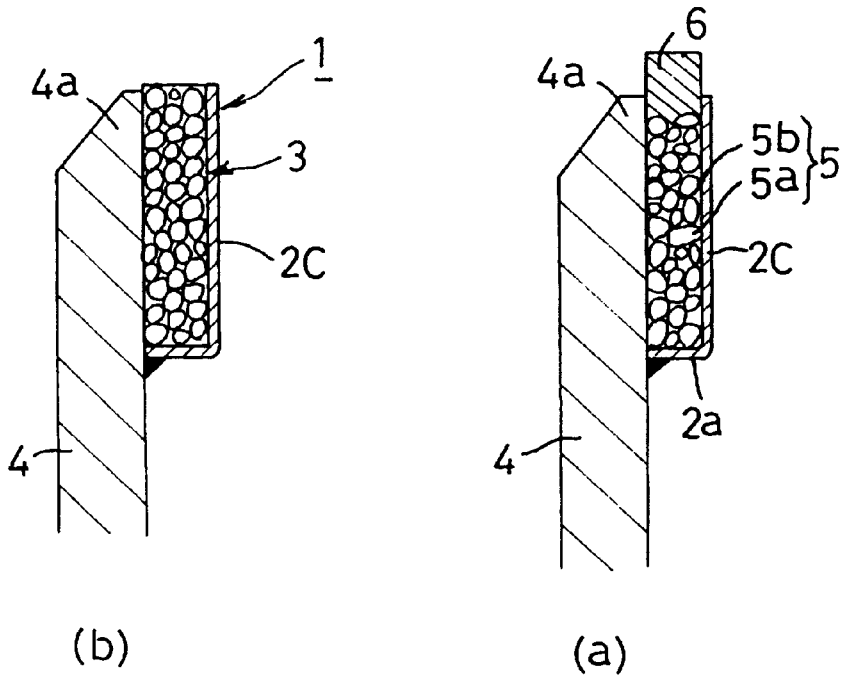
FIGS. 15 are views of cutting edges in which a hard member is directly attached to the leading end of an edge body, FIG. 15(*a*) showing a condition before attaching, FIG. 15(*b*) showing a finished condition, and FIG. 15(*c*) showing another embodiment.
Figure 15:
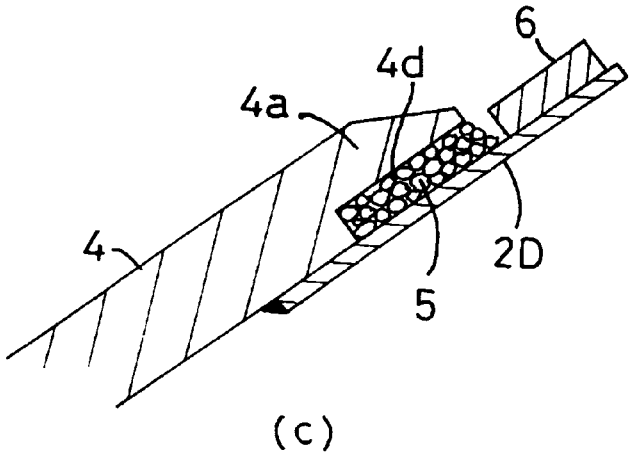

FIGS. 15 are associated with cutting edges in which the hard member is directly attached to the leading end of the edge body. FIGS. 15(*a*), 15(*b*), 15(*c*) are a view showing the condition before attaching, a view showing the finished condition and a view showing another embodiment, respectively.

As shown in FIG. 15(*a*), in this embodiment, a protective member 2C, which has been formed by bending a soft steel plate at an end to have a short leg portion 2*a* of which size corresponds to the thickness of the hard material 3 to be provided, is arc-welded to the front face of the leading end 4*a* of the edge body 4 through the short leg portion 2*a,* and a pocket having a specified width is formed in a widthwise direction. Then, the large diameter grains 5*a* and the small diameter grains 5*b* explained earlier are blended at a specified ratio and loaded into the pocket at high density. An appropriate amount of the metal 6 is then placed on the hard grains 5, the metal 6 being in the form of a bar and having a low melting point than that of the hard grains 5. Then, heat is applied from outside so that the low-melting metal 6 is melted, flowing into the pocket to infiltrate and solidify the loaded hard grains 5, thereby integrally combining the hard grains 5, the leading end 4*a* of the edge body 4 and the protective member 2C to form the cutting edge shown in FIG. 15(*b*).

According to the above process of forming the hard material 3 integrally with the edge body 4, the hard member 1 is formed at the leading end 4*a* of the edge body 4 simultaneously with the formation of the hard material 3. Therefore this process has advantage over the process in which the desired hard material is separately produced and then attached to the edge body, in terms of secure attachment of the hard material and elimination of secondary processing, which leads to cost reduction and rationalization.

Apart from the above process, there is another method as shown in FIG. 15(*c*) according to which a stepped portion 4*d* having a specified dimension is formed at the leading end portion 4*a* of the edge body 4 as a position where the hard member 1 is to be formed. Then, a soft steel plate, that is, a protective member 2D is provided in front of the stepped portion 4*d* with its proximal end joined to the edge body 4 by arc welding such that the protective member 2D sufficiently projects further than the leading end of the edge body 4. Thus, a pocket extending in a widthwise direction is made by the stepped portion 4*d* and the protective member 2D. Then, the cutting edge is inclined at an appropriate angle with the protective member 2D facing down and the blended hard particles similar to those of the foregoing embodiments are loaded into the pocket at high density. Then, the bar-like metal 6 having a specified amount and a lower melting point than that of the hard grains 5 is placed on the prolonged portion of the protective member 2D that extends from the pocket. The low-melting metal 6 is subsequently heated from outside and melted so as to flow into the pocket to infiltrate and solidify the loaded hard grains 5, thereby integrating the hard material 3 with the edge body 4 and the protective member 2D. After the solidification, the excessive end portion of the protective member is cut off so that the hard member 1 in which the hard material 3 is protected by the protective member 2D is integrally formed with the edge body 4 at the front side of the leading end of the edge body 4. The same effect as that of the foregoing embodiments can be obtained by the cutting edge having the hard member 1 thus formed.

Figure 16:
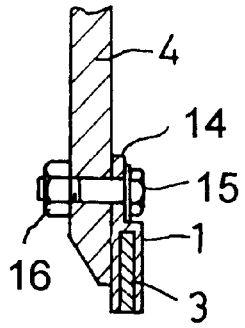
FIGS. 16(*a*) to 16(*e*) are views showing attachment of the hard member to the edge body by bolting.
Figure 16:
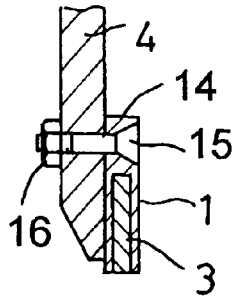
Figure 16:
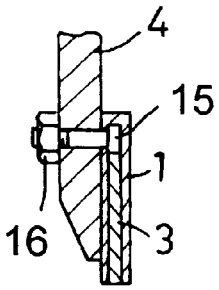
Figure 16:
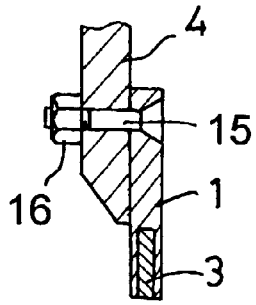
Figure 16:
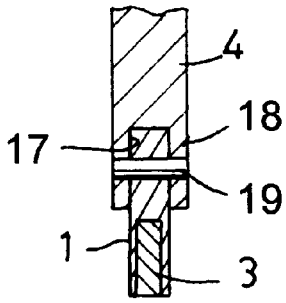

FIGS. 16(*a*) to 16(*e*) respectively show examples in which the hard member is attached to the edge body by bolt clamping.

In the example shown in FIG. 16(*a*), the hard member 1 has a structure in which the front and back faces of the hard material 3 are covered with the protective member, and the upper part which does not have the hard material 3 is thinned in a widthwise direction to make a mounting seat 14. The mounting seat 14 is provided with mounting holes 14 arranged at a specified pitch. Another set of mounting holes corresponding to the mounting holes of the mount seat 14 is formed on the edge body 4 and the bolts 15 are inserted into the respective pairs of mounting holes and secured by nuts 16 at the back face of the edge body 4. In this case, each fastening bolt 15 on the mounting seat 14 of the hard member 1 is arranged such that its head does not project from the front face of the hard member 1, and therefore snow etc. scraped by compressed snow removal operation can be moved without disturbance. FIG. 16(*b*) shows another embodiment in which the head of each fastening bolt 15 attached to the hard member 1 is embedded within the mounting seat 14.

FIG. 16(*c*) shows an embodiment in which a hard member with bolts is formed by carrying out stud welding with the fastening bolts 15 being embedded in the upper inner part of the hard material 3 of the hard member 1 or alternatively by joining the bolts 15 to the hard material during the process of forming the hard material (i.e., the process in which the hard grains are infiltrated and joined using the low-melting metal) and then, the bolts 15 are inserted into the mounting holes of the edge body 4 so as to be fastened by the nuts 16.

The embodiment shown in FIG. 16(*d*) is such that the hard member 1 is attached to the edge body 4 by the bolts 15 with their heads embedded, such that the hard member 1 projects from the leading end of the edge body 4 by a length corresponding to the length of the hard material 3 to be contained in the hard member 1. With this arrangement, when the hard material 3 is worn out, the edge body 4 can be repeatedly used only by replacing the hard member 1.

The embodiment shown in FIG. 16(*e*) is designed such that a holder portion 18 having a groove 17 in which the proximal end of the hard member 1 is to be fit is formed at the leading end of the edge body 4 and the proximal end of the hard member 1 is inserted into the groove 17 of the holder portion 18 and secured by inserting pins 19 into fastening pin holes arranged at a specified pitch. The same effect as that of the above-described exterior type hard members can be obtained by this embodiment.

Next, the cutting edge of each of the foregoing embodiments was mounted on an actual machine and its performance was tested. The results of the tests will be explained below.

(Test 1 by Use of Actual Machine)

Figure 17:
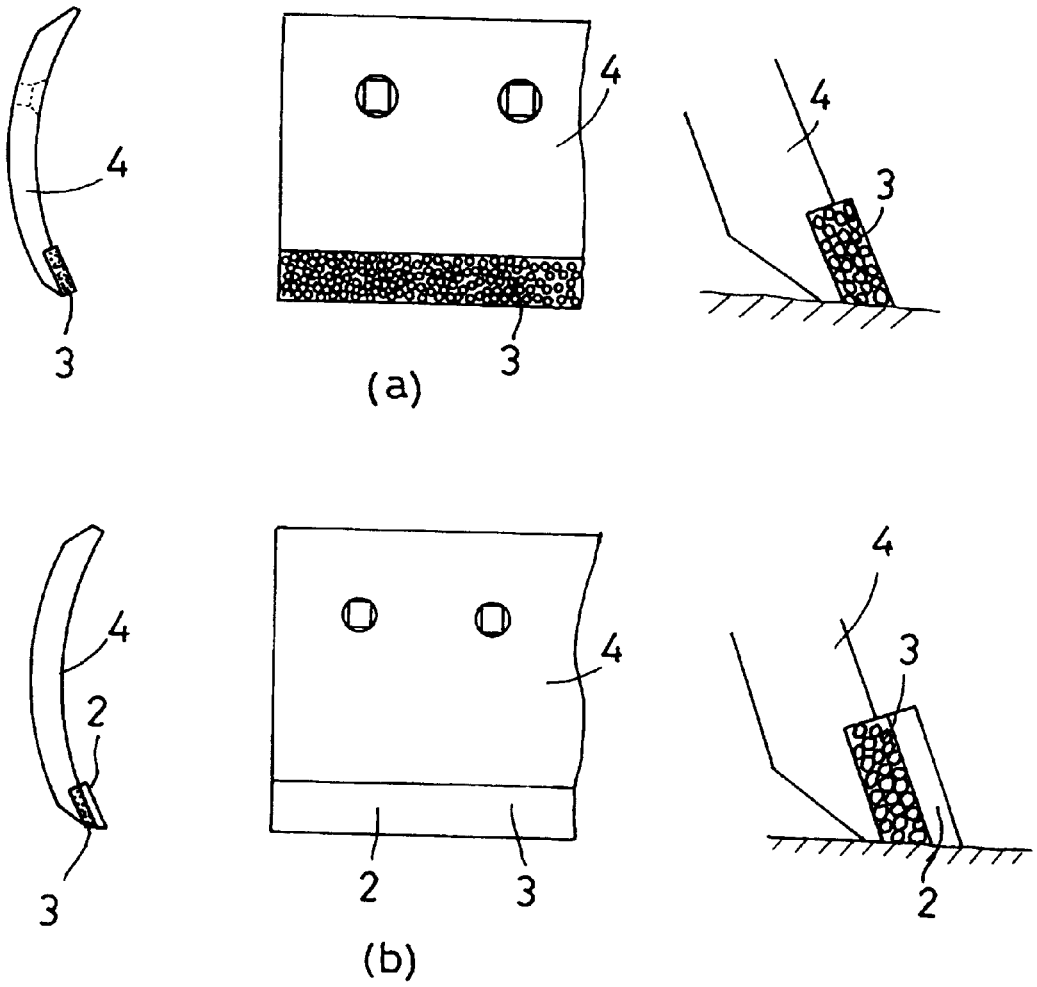
FIGS. 17 are views of two kinds of cutting edges on which a test by an actual machine was conducted, FIG. 17(*a*) showing a cutting edge in which a single piece of the hard material is attached to the front face of the edge body while FIG. 17(*b*) shows a cutting edge in which the front face of the hard material is covered with a protective member.
Figure 18:
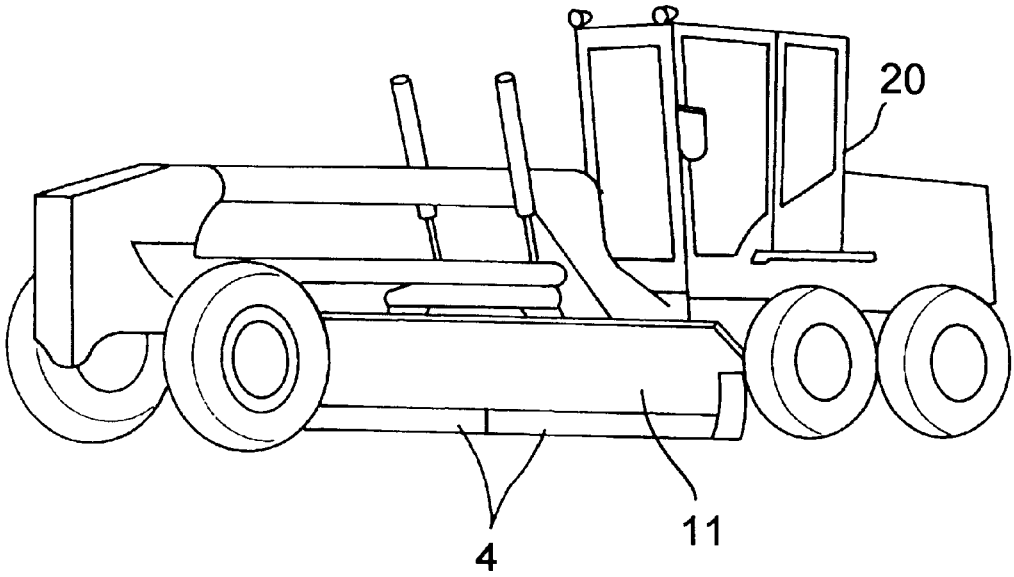
FIG. 18 shows a procedure of a test by use of an actual machine.

FIGS. 17(*a*) and 17(*b*) show a case where a test was conducted, using an actual machine, on two kinds of cutting edges each having the hard member 1 attached to the tip portion of the most popular type edge body 4 that was curved in the form of an arc and made from steel for structural purposes. Each of the hard materials used herein is made by infiltrating/joining of crushed grains (i.e., hard grains) of a hard metal by use of copper. The diameters of the hard metal grains are 0.1 to 5.0 mm. FIGS. 17(*a*) shows a condition in which the hard material 3 of the hard member is attached to the front face of the edge body 4 so as to be exposed, whereas FIG. 17(*b*) shows a condition in which the front face of the hard material 3 is covered with the protective member 2. The thickness of the hard material 3 is 5 mm, the thickness of the steel plate (soft steel) of the protective member 2 covering the front face of the hard material 3 is 3 mm, and the hard material and the steel plate are joined to each other by copper. The height of the hard material 3 is 25 mm. As shown in FIG. 18 which illustrates the procedure of the test by use of an actual machine, the two kinds of cutting edges thus formed were respectively mounted on a motor grader 20 by attaching the edge body 4 having the hard material to be tested to the blade 11 with a known means, and then snow removal was carried out. The result is shown in TABLE 1.

TABLE 1

| EDGE STRUCTURE | SERVICE LIFE (TRAVELING DISTANCE) | WEAR CONDITION OF TIP PORTION |
|---|---|---|
| FIG. 17 (a) | 470 Km | hard material was chipped into small pieces |
| FIG. 17 (b) | 1480 Km | no chipping was observed |

As apparent from TABLE 1, the service life of the cutting edge shown in FIG. 17(*b*) is about three times that of the cutting edge shown in FIG. 17(*a*). It was found from observation of the wear condition of the tip portion that the tip of the cutting edge of FIG. 17(*a*) was immediately chipped and jagged when tilting the cutting edge with its tip being sharpened. On the other hand, when tilting the cutting edge of FIG. 17(*b*), the steel plate positioned in the front was scraped off but the hard material did not get damage. It is understood from the above result that the cutting edge having the structure of the first embodiment is effective.

(Test 2 by Use of Actual Machine)

Figure 19:
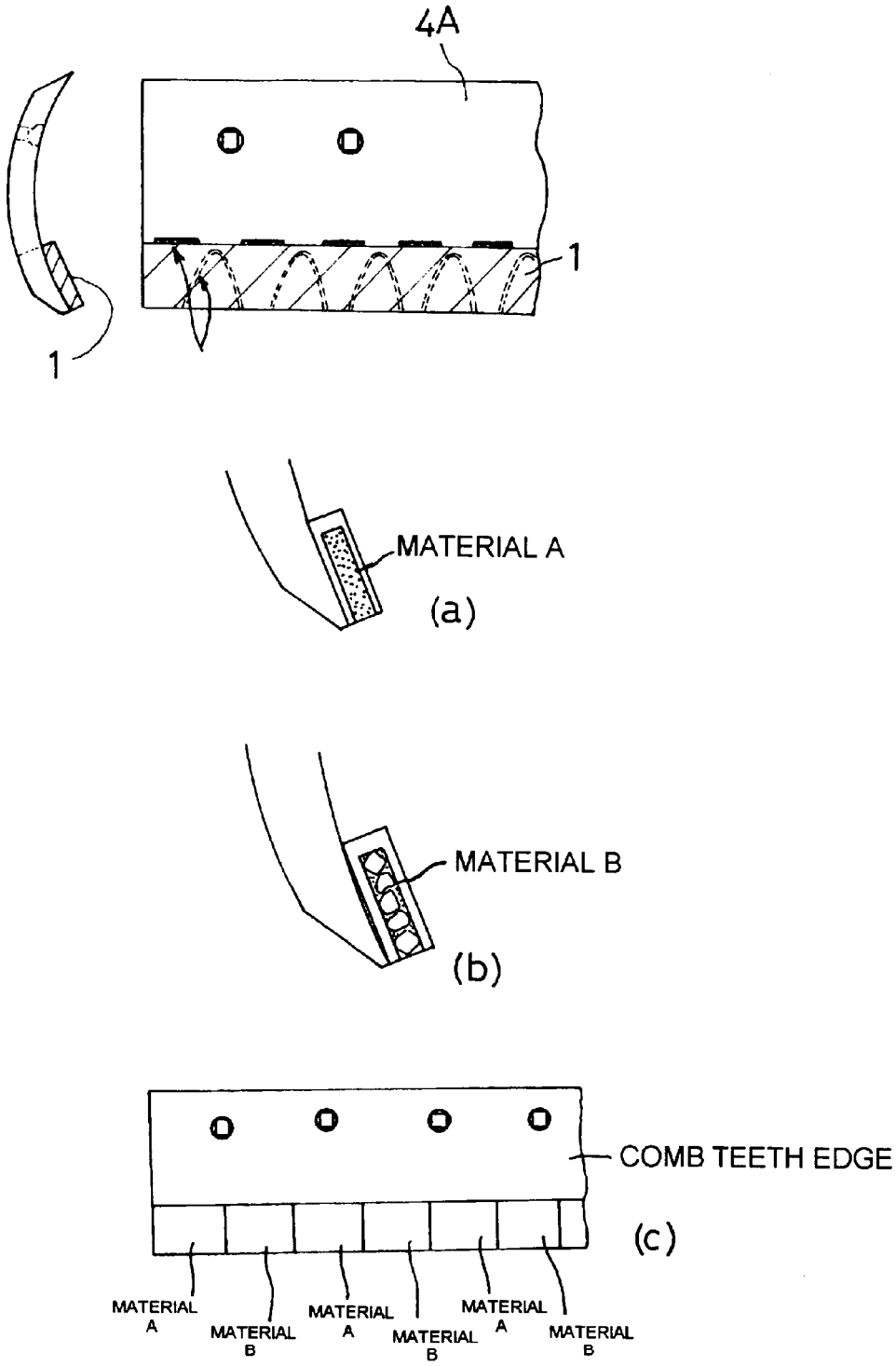
FIGS. 19 are views of three kinds of cutting edges on which a test by an actual machine was conducted, FIG. 19(*a*) showing a cutting edge in which the hard material contains small diameter grains, FIG. 19(*b*) showing a cutting edge in which the hard material contains large diameter grains and small diameter grains which have been blended and introduced at high density, FIG. 19(*c*) showing a cutting edge in which the hard materials shown in FIG. 19(*a*) and in FIG. 19(*b*) are alternately disposed.

FIGS. 19(*a*), 19(*b*), 19(*c*) show a case where a test was conducted, using an actual machine, on three kinds of cutting edges each having the hard member 1 attached to the tip portion of the most popular comb-teeth-like type edge body 4A which was curved in the form of an arc and made from steel for structural purposes. In each of the cutting edges, the hard member 1 was attached to the front faces of the comb teeth by arc welding.

The hard grains of the hard material of the hard member 1 used for the cutting edge of FIG. 19(*a*) has sizes of 0.5 mm or less (hereinafter referred to as "material A"). The hard material of the hard member 1 used for the cutting edge of FIG. 19(*b*) contains a mixture of hard grains having sizes of 0.5 mm or less and having sizes of 1.0 to 5.0 mm and has such a distribution that the gaps between the grains having sizes of 1.0 to 5.0 mm are filled with the grains having sizes of 0.5 mm or less (hereinafter referred to as "material B"). The cutting edge shown in FIG. 19(*c*) has the materials A and B which are alternately disposed. The materials A and B both have a width of 37 mm and a thickness of 6 mm. The thickness and height of the steel plate attached to the front faces of the hard materials are 3 mm and 40 mm, respectively. The three kinds of cutting edges thus arranged were respectively mounted on the motor grader 20 similarly to Test 1 to carry out snow removal. The result of this test is shown in TABLE 2.

TABLE 2

| EDGE STRUCTURE | SERVICE LIFE (TRAVELING DISTANCE) | TIP CONDITION | COMPRESSED SNOW REMOVAL PERFORMANCE (SENSORY ANALYSIS) |
|---|---|---|---|
| FIG. 19 (a) | 1800 Km | grains dropped off | — |
| FIG. 19 (b) | 2250 Km | no chipping was observed in hard material | better than (a) |
| FIG. 19 (c) | 2000 Km | materials A and B differed in wear amount so that tip was jagged | better than (b) |

As apparent from TABLE 2, it was found in the cutting edge of FIG. 19(*a*) that hard grains of the material A projected from the wear face and dropped off because of their small diameters. The road surface was not scarred by compressed snow removal. In the case of the cutting edge of FIG. 19(*b*) which used large hard metal grains, the hard grains of the material B protruded likewise but few grains dropped off, so that service life 1.25 times that of the cutting edge of FIG. 19(*a*) was obtained. In addition, in the cutting edge of FIG. 19(*b*), large hard metal grains protruded about 1 mm so that removal of compressed snow was facilitated. Scars due to scratching by the protruding grains were found when observing the road surface after compressed snow removal. In the cutting edge of FIG. 19(*c*), the region of the tip portion corresponding to the material B somewhat projected since the wear resistance of the material B was higher than that of the material A. In the material B, the large hard grains projected as described earlier. By virtue of the tip portion in such a form, the contact pressure of the cutting edge of FIG. 19(*c*) was locally higher than that of the cutting edge of FIG. 19(*b*) in the regions where the material B was provided, so that improved performance of compressed snow removal could be obtained. However, the service life of the cutting edge of FIG. 19(*c*) is somewhat inferior to that of the cutting edge of FIG. 19(*b*).

Figure 20:
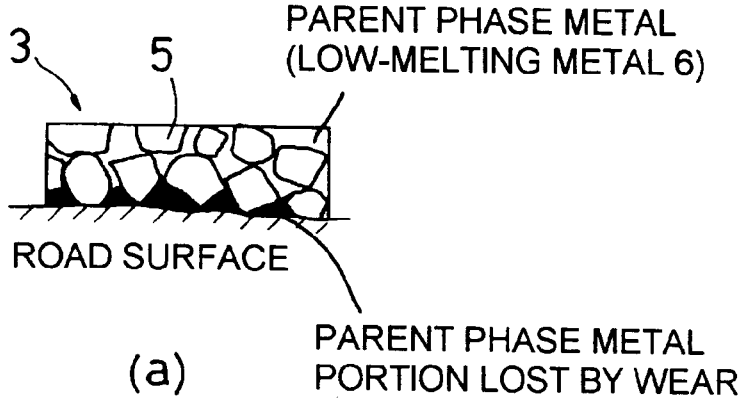
FIGS. 20(*a*) and 20(*b*) diagrammatically show worn portions of the hard material.
Figure 20:
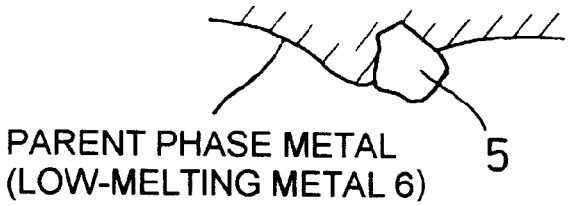
Figure 21:
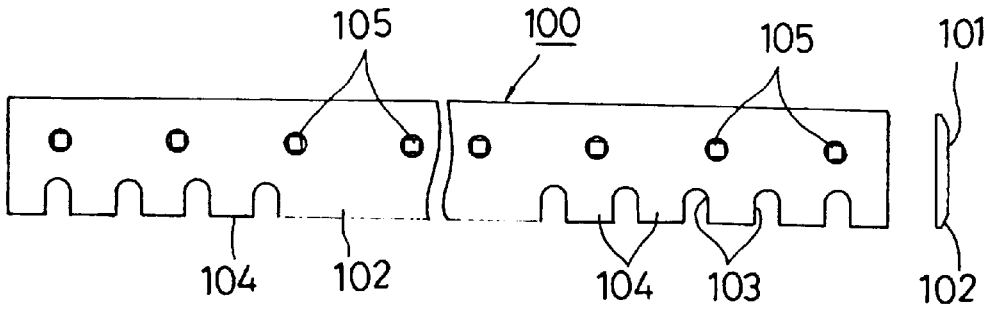
FIG. 21 is a conventional cutting edge made from a steel plate.
Figure 22:
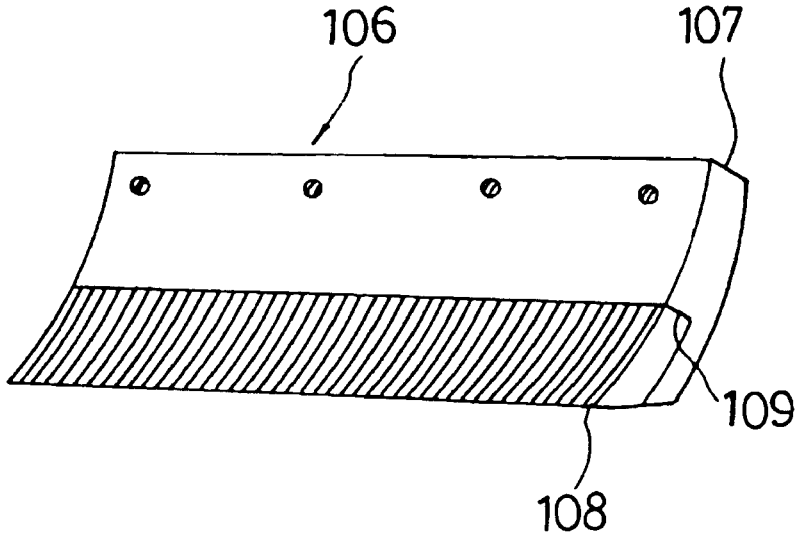
FIG. 22 is a conventional cutting edge having teeth made from a hard metal.
Figure 23:
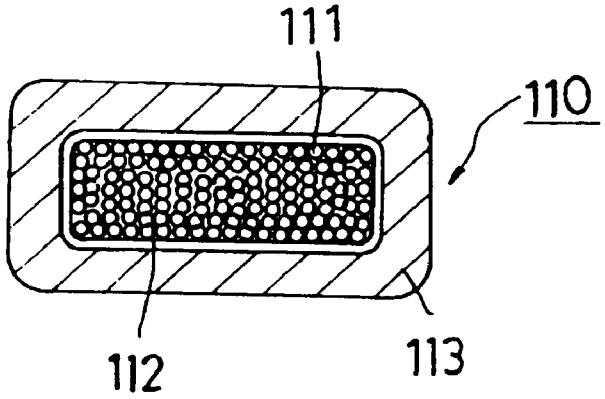
FIG. 23 is a sectional view showing the structure of a hard material proposed as prior art.
Figure 24:
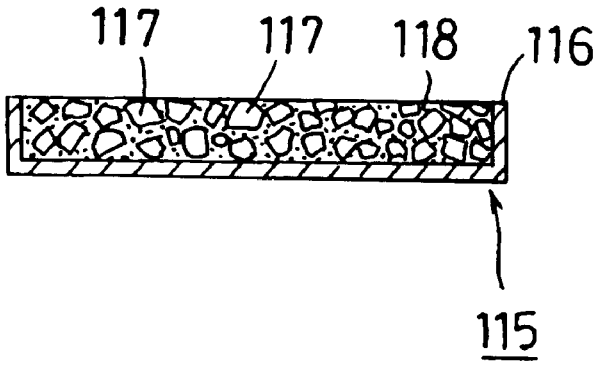
FIG. 24 is a sectional view showing the structure of another hard material proposed as prior art.
Figure 25:
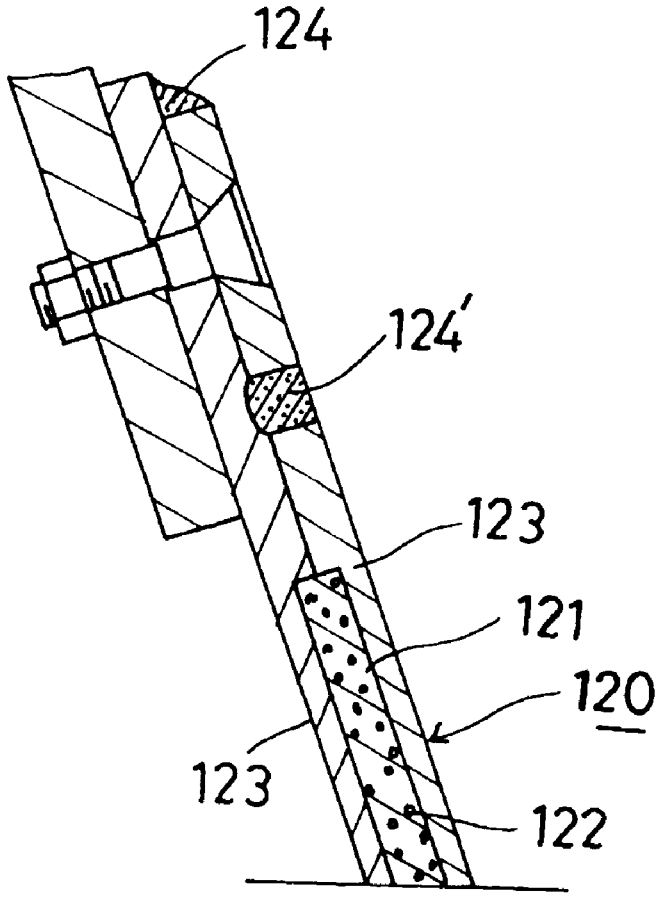
FIG. 25 is a partial sectional view of a conventional cutting edge using a hard material.
Figure 26:
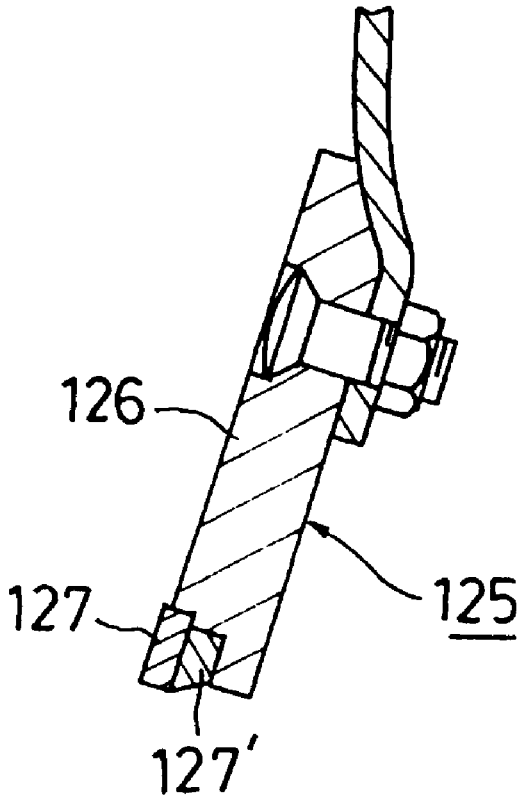
FIG. 26 is a partial sectional view of a conventional cutting edge in which a hard material is attached to its tip portion.
Figure 27:
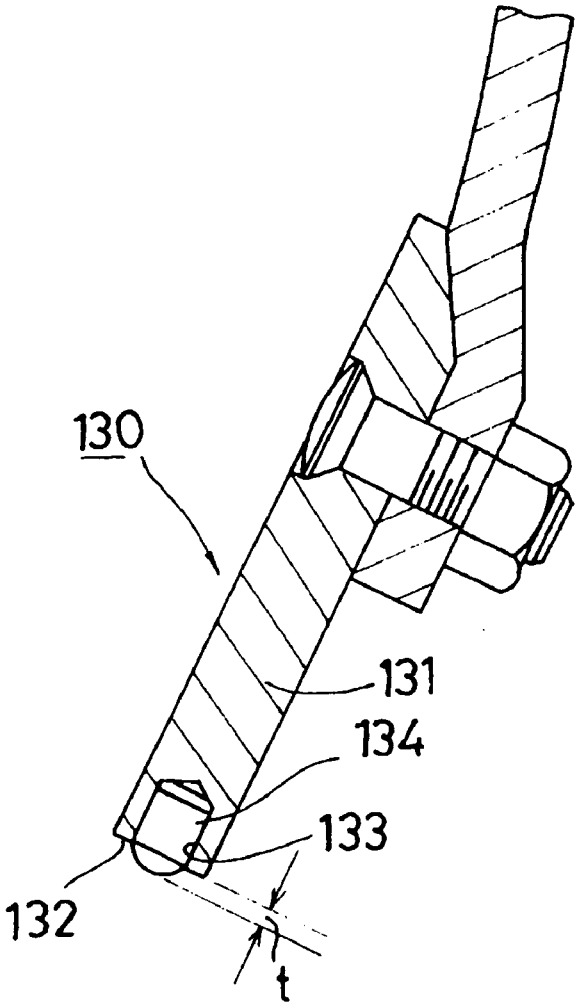
FIG. 27 is a partial sectional view of a conventional cutting edge in which a pin made of a hard material is attached to its tip portion.
Figure 28:
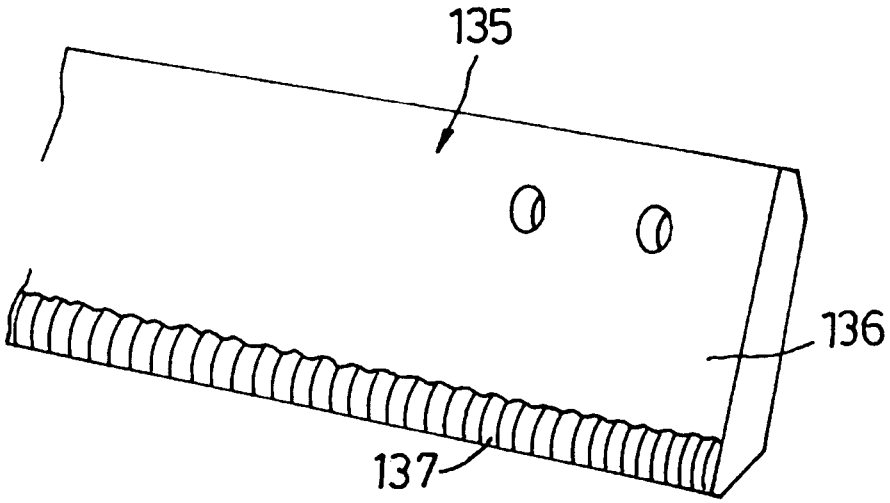
FIG. 28 is a view of a conventional cutting edge in which a hard material is overlaid to its tip portion.

The following fact was confirmed from the results of Tests 1 and 2 by use of an actual machine. In the regions of the worn hard member 1 where the hard grains 5 of the hard material 3 are kept without dropping off, even if the parent phase metal portion is scraped off by scratching wear at the leading end of the hard material 3, the parent phase metal remains on the back of the hard grains 5 supporting the hard grains 5 as diagrammatically shown in FIGS. 20(*a*) and 20(*b*) so that the hard grains 5 are unlikely to drop off and, in consequence, the hard grains 5 exert its compressed snow scraping function by projecting.

It is obvious from the foregoing description that the cutting edge of the invention can exert its superior effects of impact resistance and wear resistance not only in snow removal but also in civil engineering works.

What is claimed is:

1. A cutting edge comprising an edge body mounted on a blade and a hard member provided at a leading end of the edge body, wherein the hard member comprises:

a first hard material containing hard grains which are dispersed with high filling density and are integrally combined by a metal having a lower melting point than the hard grains; and a protective member which covers at least a front face of the hard material as viewed in the travel direction of the blade and which has impact resistance, wherein said first hard material contains hard grains consisting solely of large diameter hard grains having diameters of 1 mm or more distributed in the entire area of the hard material with small diameter hard grains having diameters of 0.5 mm or less filling gaps between the large diameter hard grains.

2. A cutting edge according to claim 1, wherein said protective member is constituted by a part of said edge body.

3. A cutting edge according to claim 2, wherein said first hard material is disposed on a back face of the edge body as viewed in the travel direction of the blade and at least the back face of the first hard material as viewed in the travel direction of the blade is covered with a steel plate.

4. A cutting edge according to claim 2, wherein said edge body is provided with a groove at its ground contact face and said first hard material is disposed within the groove.

5. A cutting edge according to claim 1, wherein said hard grains are crushed and/or granulated grains of a hard metal mainly containing a tungsten carbide alloy.

6. A cutting edge according to claim 1, wherein said low-melting point metal is Cu, a Cu alloy or an Ni self fluxing alloy.

7. A cutting edge according to claim 1, wherein said large diameter hard grains are distributed, being mixed with small diameter hard grains having diameters of 0.5 mm or less.

8. A cutting edge according to claim 1, wherein the leading end of the hard member is made such that portions of different thicknesses are alternately arranged in the widthwise direction of the edge body.

9. A cutting edge according to claim 1, wherein said first hard material is spaced at appropriate intervals in a widthwise direction of the edge body at the leading end of the edge body.

10. A cutting edge according to claim 1, wherein said hard member is attached to the leading end of the edge body by infiltration of the low-melting point metal.

11. A cutting edge according to claim 1, wherein said hard member is attached to the leading end of the edge body by welding.

12. A cutting edge according to claim 1, wherein said hard member is attached to the leading end of the edge body by brazing.

13. A cutting edge according to claim 1, wherein said hard member is attached to the leading end of the edge body by bolting.

14. A cutting edge comprising an edge body mounted on a blade and hard member provided at a leading end of the edge body, wherein the hard member comprises:

a first hard material containing hard grains which are dispersed with high filling density and are integrally combined by a metal having a lower melting point than the hard grains; and a protective member which covers at least a front face of the hard material as viewed in the travel direction of the blade and which has impact resistance, and further comprising a second hard material, containing hard grains which are dispersed with high filling density and integrally combined by a metal having a lower melting point than the hard grains, having different wear resistance than said first hard material, alternately arranged in widthwise direction of the edge body at a leading end of the edge body.

15. A cutting edge comprising an edge body mounted on a blade and a hard member provided at a leading end of the edge body, wherein the hard member comprises:

a first hard material containing hard grains which are dispersed with high filling density and are integrally combined by a metal having a lower melting point than the hard grains; and a protective member which covers at least a front face of the hard material as viewed in the travel direction of the blade and which has impact resistance, wherein said protective member is separated from said edge body, formed by bending a steel plate into a substantially L shape and attached to the leading end of said edge body.

16. A cutting edge comprising an edge body mounted on a blade and a hard member provided at a leading end of the edge body, wherein the hard member comprises:

a first hard material containing hard grains which are dispersed with high filling density and are integrally combined by a metal having a lower melting point than the hard grains; and a protective member which covers at least a front face of the hard material as viewed in the travel direction of the blade and which has impact resistance wherein said protective member is separated from said edge body, formed by bending a steel plate so as to cover three faces of the edge body excluding its ground contact face and attached to the leading end of said edge body.

* * * * *